United States Patent [19]

Kilbane et al.

[11] Patent Number: 5,066,549

[45] **Date of Patent: * Nov. 19, 1991**

[54] HOT DIP ALUMINUM COATED CHROMIUM ALLOY STEEL

[75] Inventors: Farrell M. Kilbane, Centerville; Richard A. Coleman, Middletown; Frank C. Dunbar, West Chester; Alan F. Gibson, Middletown, all of Ohio

[73] Assignee: Armco Inc., Middletown, Ohio

[ * ] Notice: The portion of the term of this patent subsequent to Jan. 24, 2006 has been disclaimed.

[21] Appl. No.: 275,147

[22] Filed: Nov. 22, 1988

Related U.S. Application Data

[60] Continuation of Ser. No. 16,920, Feb. 20, 1987, Pat. No. 4,800,135, which is a division of Ser. No. 865,238, May 20, 1986, Pat. No. 4,675,214.

[51] Int. Cl.[5] ..... B32B 15/18

[52] U.S. Cl. ..... 428/653; 428/685

[58] Field of Search ..... 428/653, 681, 684, 685

[56] References Cited

U.S. PATENT DOCUMENTS

| | | | |
|---|---|---|---|
| 3,378,359 | 4/1968 | Walston et al. | 29/196.2 |
| 3,396,048 | 8/1968 | Speed | 117/51 |
| 3,907,611 | 9/1975 | Sasame et al. | 148/6.3 |
| 3,925,579 | 12/1975 | Flinchum et al. | 427/320 |
| 4,040,981 | 9/1977 | Inaba et al. | 252/463 |
| 4,079,157 | 3/1978 | Yagi et al. | 427/380 |
| 4,150,178 | 4/1979 | Yagi et al. | 427/380 |
| 4,535,034 | 8/1985 | Zaizen et al. | 428/653 |
| 4,601,999 | 7/1986 | Retallick et al. | 502/314 |
| 4,800,135 | 1/1989 | Kilbane et al. | 428/653 |
| 4,883,723 | 11/1989 | Kilbane et al. | 428/653 |

FOREIGN PATENT DOCUMENTS

| | | |
|---|---|---|
| 12515 | 1/1973 | Japan . |
| 26187 | 2/1982 | Japan . |
| 245727 | 12/1985 | Japan . |
| 262950 | 12/1985 | Japan . |
| 147865 | 7/1986 | Japan . |
| 147866 | 7/1986 | Japan . |

*Primary Examiner*—R. Dean
*Assistant Examiner*—George Wyszomierski
*Attorney, Agent, or Firm*—R. J. Bunyard; L. A. Fillnow; R. H. Johnson

[57] ABSTRACT

Continuously hot dip aluminum coated ferritic chromium alloy steel strip. After the steel has been given a pretreatment to remove surface contaminants, the steel is protected in a hydrogen atmosphere until it is passed into the molten aluminum coating metal. The coating metal readily wets the steel surface to prevent uncoated areas or pin holes in the coating layer.

8 Claims, 1 Drawing Sheet

HOT DIP ALUMINUM COATED CHROMIUM ALLOY STEEL

This application is a continuation of application Ser. No. 016,920, filed Feb. 20, 1987, now issued as U.S. Pat. No. 4,800,135, which is a division of application Ser. No. 865,238, filed May 20, 1986, now issued as U.S. Pat. No. 4,675,214.

BACKGROUND OF THE INVENTION

This invention relates to a continuously hot dipped metallic coated ferritic chromium alloy ferrous base strip and a process to enhance the wetting of the strip surface with commercially pure molten aluminum.

Hot dip aluminum coated steel exhibits a high corrosion resistance to salt and finds various applications in automotive exhaust systems and combustion equipment. In recent years, automotive combustion gases have increased in temperature and become more corrosive. For this reason, there has become a need to increase high temperature oxidation resistance and salt corrosion resistance by replacing aluminum coated low carbon or low alloy steels with aluminum coated chromium alloy steels. For high temperature oxidation and corrosion resistance, at least part of the aluminum coating layer can be diffused into the iron base by the heat during use to form an Fe-Al alloy layer. If uncoated areas are present in the aluminum coating layer, accelerated corrosion leading to perforation of the base metal may result if the Fe-Al alloy is not continuously formed in the base metal.

It is well known to hot dip metallic coat steel strip without a flux by subjecting the strip to a preliminary treatment which provides a clean surface free of oil, dirt and iron oxide which is readily wettable by the coating metal. Two types of preliminary in-line anneal treatments for carbon steel are described in U.S. Pat. No. 2,197,622 issued to T. Sendzimir and U.S. Pat. No. 3,320,085 issued to C. A. Turner, Jr.

The Sendzimir process for preparation of carbon steel strip for hot dip zinc coating involves passing the strip through an oxidizing furnace heated, without atmosphere control, to a temperature of 1600° F. (870° C.). The heated strip is withdrawn from the furnace into air to form a controlled surface oxide. The strip is then introduced into a reducing furnace containing a hydrogen and nitrogen atmosphere wherein the residence time is sufficient to bring the strip to a temperature of at least 1350° F. (732° C.) and to reduce the surface oxide. The strip is then cooled to approximately the temperature of the molten zinc coating bath and led through a snout containing a protective pure hydrogen or hydrogen-nitrogen atmosphere to beneath the surface of the coating bath.

The Turner process, normally referred to as the Selas process, for preparation of carbon steel strip for hot dip metallic coating involves passing the strip through a furnace heated to a temperature of at least 2200° F. (1204° C.). The furnace atmosphere has no free oxygen and at least 3% excess combustibles. The strip remains in the furnace for sufficient time to reach a temperature of at least 800° F. (427° C.) while maintaining a bright clean surface. The strip is then introduced into a reducing furnace section having a hydrogen-nitrogen atmosphere wherein the strip may be further cooled to approximately the molten coating metal bath temperature and led through a snout containing a protective hydrogen-nitrogen atmosphere to beneath the surface of the coating bath.

U.S. Pat. No. 3,925,579 issued to C. Flinchum et al. describes an inline pretreatment for hot dip aluminum coating low alloy steel strip to enhance wettability by the coating metal. The steel contains one or more of up to 5% chromium, up to 3% aluminum, up to 2% silicon and up to 1% titanium. The strip is heated to a temperature above 1100° F. (593° C.) in an atmosphere oxidizing to iron to form a surface oxide layer, further treated under conditions which reduce the iron oxide whereby the surface layer is reduced to a pure iron matrix containing a uniform disperson of oxides of the alloying elements.

It is well know that hot dip aluminum coatings do not wet cleaned steel surfaces as easily as zinc coatings. U.S. Pat. No. 4,155,235 to Pierson et al. discloses the importance of keeping hydrogen gas away from the entry section of an aluminum coating bath. This patent teaches a cleaned steel must be protected in a nitrogen atmosphere just prior to hot dip aluminum coating to prevent uncoated spots.

The problems associated with non-wetting of aluminum coatings onto ferritic stainless steel are also well known. Hot dip aluminum coatings are poorly adherent to ferritic stainless steel base metals and normally have uncoated or bare spots in the aluminum coating layer. By poor adherence is meant flaking or crazing of the coating during bending of the strip. To overcome the adherence problem, some have proposed heat treating the aluminum coated stainless steel to anchor the coating layer to the base metal. Others lightly reroll the coated stainless steel to bond the aluminum coating. Finally, those concerned about uncoated spots have generally avoided continuous hot dip coating. Rather, batch type hot dip coating or spray coating processes have been used. For example, after a stainless steel article has been fabricated, it is dipped for an extended period of time within an aluminum coating bath to form a very thick coating layer.

No one has proposed a solution for enhancing the wetting of ferritic chromium alloy steels using hot dip aluminum coatings. Without good surface wetting, the aluminum coating layer will not be uniform, free of uncoated areas and strongly adherent to the steel base metal. We have discovered a coating method for overcoming the wetting problems associated with hot dip aluminum coating of ferritic chromium alloy steel. The wetting is dramatically improved if a cleaned ferritic chromium alloy steel is maintained in a protective hydrogen atmosphere substantially void of nitrogen prior to the entry of the steel into an aluminum coating bath.

BRIEF SUMMARY OF THE INVENTION

This invention relates to a continuous hot dip aluminum coated ferrous base ferritic steel containing at least about 6% by weight chromium. The surface of the steel is pretreated to remove oil, dirt, oxides and the like. The steel is then heated to at least 1250° F. (677° C.) and then protected in an atmosphere containing at least about 95% by volume hydrogen with the steel being maintained at a temperature near or slightly above the melting point of a coating metal consisting essentially of aluminum. The hydrogen atmosphere enhances the wetting of the ferritic chromium steel to substantially eliminate uncoated or pin hole defects in the aluminum coating layer.

It is a principal object of this invention to form hot dip aluminum coated ferritic chromium alloy steels having enhanced wetting by the coating metal.

An advantage of our invention is elimination of uncoated areas and improved adherence to ferritic chromium alloy base metals when hot dip coating with aluminum.

Another advantage of our invention is improved high temperature oxidation and salt corrosion resistance thereby increasing base metal perforation resistance for aluminum coated ferritic chromium alloy steels used in automotive exhaust systems.

The above and other objects, features and advantages of this invention will become apparent upon consideration of the detailed description and appended drawing.

DETAILED DESCRIPTION OF THE PREFERRED EMBODIMENT

Figure 1:
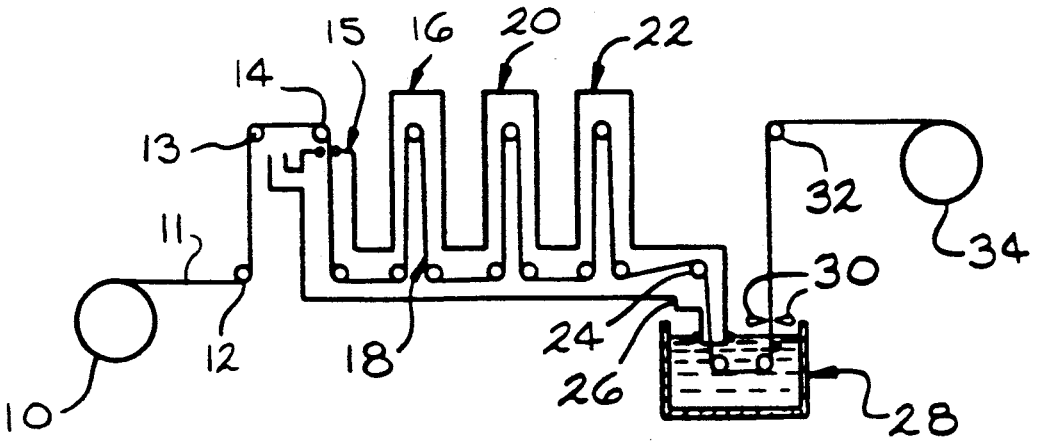
FIG. 1 is a schematic view of a ferrous base strip being processed through a conventional hot dip aluminum coating line incorporating the present invention.

Referring now to FIG. 1, reference numeral 10 denotes a coil of steel with strip 11 passing therefrom and around rollers 12, 13 and 14 before entering the top of first furnace section 15. This first section of furnace 15 may be a direct fired type having approximately 5 percent excess of combustibles introduced therein. The furnace atmosphere temperature may be on the order of 2300° F. (1260° C.). Strip surface contaminants such as oil and the like are almost instantaneously burned and removed.

The second section of the furnace denoted by numeral 16 may be of a radiant tube type. The temperature of strip 11 may be further heated to about 1250° F. (677° C.) to 1750° F. (954° C.) and reaching a maximum temperature at about point 18. A reducing atmosphere will be supplied to section 16 as well as succeeding sections of the furnace described below. The atmosphere must be as reducing, and preferrably more so, than that used for carbon steels to minimize oxidation of chromium in the base metal.

The third section of the furnace generally denoted by numeral 20 is a cooling zone.

The final section of the furnace generally denoted by numeral 22 is a final cooling zone. Strip 11 passes from furnace portion 22, over turndown roller 24, through snout 26 and into coating pot 28 containing molten aluminum. The strip remains in the coating pot a very short time (i.e., 2–5 seconds). Strip 11 containing a layer of coating metal is vertically withdrawn from coating pot 28. The coating layer is solidified and the coated strip is passed around turning roller 32 and coiled for storage or further processing in coil 34.

Figure 2:
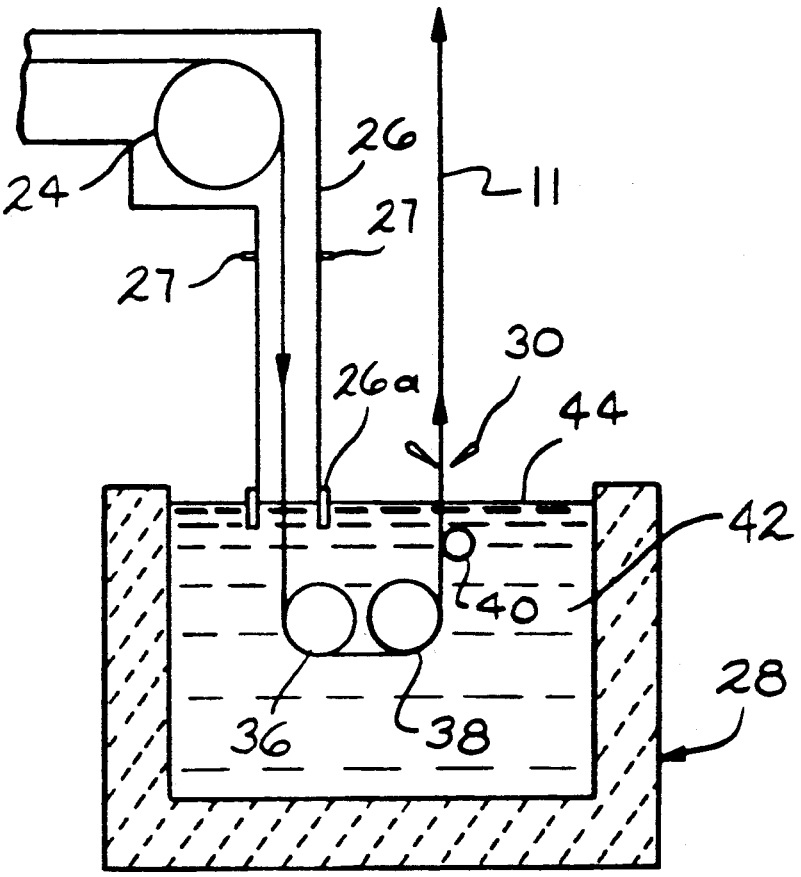
FIG. 2 is a partial schematic view of the coating line of FIG. 1 showing an entry snout and coating pot.

Referring now to FIG. 2, snout 26 is protected from the atmosphere by having its lower or exit end **26*a* submerged below surface 44 of aluminum coating metal 42. Suitably mounted for rotation are pot rollers 36 and 38 and stabilizer roller 40. The weight of coating metal 42 remaining on strip 11 as it is withdrawn from the coating pot is controlled by a coating means such as jet finishing knives 30. Strip 11 is cooled to a temperature near or slightly above the melting point of the aluminum coating metal in furnace portions 20, 22 and snout 26** before entering the coating pot. This temperature may be as low as about 1220° F. (660° C.) to as high as about 1350° F. (732° C.).

The process thus far described is well known in the art and is for two side coating using air finishing. As will be understood by those skilled in the art, modifications to the pretreatment process for cleaning the strip surface may be used such as using wet cleaning instead of the direct fired furnace. Furthermore, it will be understood by those skilled in the art one-side hot dip coating or finishing using a sealed enclosure containing a non-oxidizing atmosphere may be used with this invention.

Referring to FIG. 2, our invention will be described in detail. To enhance the wetting of a hot dip aluminum coating metal to steel strip containing a ferritic alloy of at least about 6% by weight chromium, the steel strip is given a suitable pretreatment to remove dirt, oil film, oxides and the like. The strip is further heated in an atmosphere reducing to iron such as containing 20% by volume hydrogen and 80% by volume nitrogen and thereafter passing the cleaned strip through a protective atmosphere of substantially all hydrogen just before entering the coating bath. When an in-line annealing such as described above is used to clean the strip, the protective atmosphere is maintained in an enclosure such as enclosed snout 26. Hydrogen gas can be introduced as necessary such as through inlets 27. The protective atmosphere must contain at least about 95%, more preferably at least 97%, and most preferably as close to 100% as possible, by volume hydrogen.

It is also very important to control oxygen and dew point of the protective atmosphere as well as maintaining a high molten metal temperature in the coating pot. A thin oxide layer on the surface of a steel strip may be reduced by the reactive aluminum coating metal. Chromium is much more readily oxidized than iron so that chromium alloy steels are more likely to be non-wetted because of excessively thick oxide films than carbon steels. Accordingly, the protective hydrogen atmosphere must have a dew point no higher than about +40° F. (4° C.) and containing no more than about 200 ppm oxygen. Preferably, the dew point should be less than +10° F. (−12° C.) and oxygen less than 40 ppm.

Substantially pure aluminum coating metals are normally maintained at about 1250° F. (677° C.) to 1270° F. (688° C.) for coating carbon steel. Because of the increased tendency for chromium alloy steels to oxidize, we must maintain our coating metal at least this high and preferably in the range of 1280° F. (693° C.) to 1320° F. (716° C.). This increased temperature increases the reactivity of the coating metal making it more reducing to chromium oxide. The temperature should not exceed about 1320° F. (716° C.) because an excessively thick brittle Fe-Al alloy layer may form.

The present invention has particular usefulness for hot dip aluminum coated ferritic stainless steels used in automotive exhaust applications, including thin foils used as supports for catalytic converters. This later steel is described in an application filed June 4, 1985 under U.S. Ser. No. 741,282 now issued as U.S. Pat. No. 4,686,155 and assigned to a common assignee. A ferritic stainless steel containing at least about 10% by chromium having a hot dip coating of substantially pure aluminum will have excellent corrosion resistance. Unlike aluminum coated carbon steel, we have discovered that a ferritic stainless steel hot dip coated with pure aluminum may be severely fabricated without flaking or crazing the coating layer. It has been determined a Type 409 stainless steel containing about 10.0% to about 14.5% by weight chromium, about 0.1% to about 1.0% by weight silicon, about 0.2% to about 0.5% titanium and the remainder iron may be hot dip coated with pure aluminum. Furthermore, the coated strip may be cold reduced from strip of at least 0.25 mm thickness to less than 0.1 mm without peeling the coating metal. Because the aluminum coating layer has excellent adherence to the base metal and does not contain pin hole or uncoated areas, a diffusion heat treated foil has excellent oxidation resistance at high temperature. For example, the foil may be used as catalyst supports in automotive exhausts having operating temperatures of about 1500° F. (800° C.)–1650° F. (900° C.) with "brief excursions" as high as 2200° F. (1204° C.).

In addition to carbon and low alloy steels, chromium alloy steels containing substantial amounts of nickel are readily hot dip aluminum coated using conventional practice. By substantial amount of nickel is meant in excess of about 3% by weight such as austenitic stainless steels. Chromium alloy steels containing 3% or more nickel apparently are easily coated with aluminum because the nickel appears to form a very tight bond with the aluminum. Accordingly, these high nickel chromium alloy steels may be readily hot dip coated with aluminum without using our invention. Most hot dip aluminum coatings contain about 10% by weight silicon. This coating metal is generally defined in the industry as Type 1. We have discovered this type aluminum coating metal does not wet well with ferritic chromium alloy steel, even when using the hydrogen protective atmosphere. While not being bound by theory, it is believed silicon exceeding 0.5% by weight decreases the reactivity of the aluminum coating metal needed to react with a ferritic chromium alloy steel substrate. Accordingly, silicon contents in the coating metal should not exceed about 0.5% by weight.

Commercially pure hot dip aluminum coatings, otherwise known as Type 2 in the industry, are preferred for our invention. By "pure" aluminum is meant those aluminum coating metals where addition of substantial amounts of alloying elements, such as silicon, are precluded. It will be understood the coating metal may contain residual amounts of impurities, particularly iron. The coating bath typically contains about 2% by weight iron caused primarily by dissolution of iron from the steel strip passing through the bath.

EXAMPLE 1

To illustrate the inability to prevent uncoated areas when using a conventional protective atmosphere, 3 inch wide (76 mm) strip of 409 stainless was given an in-line anneal pretreatment on a laboratory pilot line. The direct fired portion of the furnace was heated to about 2150° F. (1175° C.) and the strip peak metal temperature observed was about 1650° F. (899° C.). The strip was cooled to about 1285° F. (696° C.) in the snout just prior to entry into the aluminum coating bath.

The steel strip was protected in the snout portion of the furnace using a protective atmosphere containing about 25% by volume hydrogen and the balance nitrogen with a dew point less than −15° F. (−26° C.) and less than 40 ppm oxygen. The aluminum coating metal in the coating pot was maintained at about 1285° F. (696° C.). The as-coated strip contained an estimated uncoated area of about 25% and occasionally was as high as 75%.

EXAMPLE 2

To demonstrate the enhanced wetting when using a protective atmosphere according to the invention, a 3 inch (76 mm) wide strip of 409 stainless steel was coated on the same pilot line and was given an in-line anneal pretreatment having temperatures similar to those set forth in Example 1. However, the atmosphere was adjusted to include about 100% by volume hydrogen, −15° F. (−26° C.) dew point and less than 40 ppm oxygen. The as-coated strip appearance was excellent and no visible uncoated areas or pin holes were apparent.

EXAMPLE 3

A 3 inch (76 mm) strip of 409 stainless steel was coated on the pilot line. The strip was heated to a peak metal temperature of 1600° F. (871° C.) and was cooled to 1280° F. (693° C.) in the snout just prior to entry into the aluminum coating bath. The atmosphere contained a dew point of −15° F. (−26° C.) and 20 ppm oxygen. A gas chromatograph was installed in the snout so that strip as-coated coating quality could be observed as the amount of hydrogen in the protective atmosphere was varied. When the atmosphere was about 92% by volume hydrogen and the balance nitrogen, the coating quality was unacceptable. Increasing the hydrogen to about 94% by volume produced what was considered to be marginally acceptable coating quality. When the hydrogen was increased to 97% by volume, the coating quality observed was considered to be excellent and the coating layer had substantially no uncoated areas.

A trial was also run on a production size hot dip aluminum coating line. The following temperature-atmosphere conditions were used and coating quality observations made:

| Ex. | DFF* Temp. °F. (°C.) | Peak Metal Temp. °F. (°C.) | Pot Temp. °F. (°C.) | Dew Point °F. (°C.) | % Hydrogen | Observation |
|---|---|---|---|---|---|---|
| 4. | 1040 (560) | 1400 (760) | 1270 (687) | +7 (−14) | 0 | 50% uncoated |
| 5. | 1040 (560) | 1400 (760) | 1270 (687) | +7 (−14) | 100 | no uncoated |
| 6. | 1300 (704) | 1600 (871) | 1280 (693) | +25 (−4) | 100 | 15% uncoated |
| 7. | 1300 (704) | 1600 (871) | 1300 (704) | +30 (−1) | 100 | no uncoated |

*Strip temperature in the direct fired furnace section

Various modifications can be made to our invention without departing from the spirit and scope of it. For example, various modifications may be made to the protective atmosphere so long as it includes at least about 95% by volume hydrogen. Furthermore, modifications may be made to the strip pretreatment as well as using one-side coating or non-oxiding jet finishing. Therefore, the limits of our invention should be determined from the appended claims.

We claim:

1. A ferrous base ferritic strip continuously hot dip coated with a coating metal, comprising:

the strip including at least about 6% by weight chromium, the coating metal including aluminum or aluminum alloys, the coating layer on the strip being substantially free of uncoated areas and formed without a thick brittle Fe-Al alloy inner layer, the coating layer being tightly adherent to the strip and resistant to crazing or flaking during bending.

2. The strip of claim 1 wherein the coating metal includes less than about 0.5% by weight silicon.

3. The strip of claim 1 wherein the aluminum coating metal contains up to about 10% by weight silicon.

4. The strip of claim 1 wherein the aluminum coating metal contains up to 0.5% by weight silicon and up to about 2% by weight iron.

5. A ferritic steel strip continuously hot dip coated with an aluminum coating metal, comprising:

the strip being stainless steel including at least about 10% by weight chromium, the coating layer on the strip being substantially free of uncoated areas and formed without a thick brittle Fe-Al alloy inner layer, the coating layer being tightly adherent to the strip and resistant to crazing or flaking during bending.

6. The strip of claim 5 wherein the coating metal includes less than about 0.5% by weight silicon.

7. The strip of claim 5 wherein the aluminum coating metal contains up to about 10% by weight silicon.

8. The strip of claim 5 wherein the aluminum coating metal contains up to 0.5% by weight silicon and up to about 2% by weight iron.

* * * * *

UNITED STATES PATENT AND TRADEMARK OFFICE

CERTIFICATE OF CORRECTION

PATENT NO. : 5,066,549

DATED : 11-19-91

INVENTOR(S) : Farrell M. Kilbane, Richard A. Coleman, Frank C. Dunbar, Alan F. Gibson It is certified that error appears in the above-identified patent and that said Letters Patent is hereby corrected as shown below:

The following text should appear immediately prior to the paragraph beginning in column 6, line 55:

-- Example 4 showed that 50% of the strip was uncoated when an atmosphere of 100 % by volume nitrogen was used in the snout. Uncoated areas on the strip disappeared when 100 % by volume hydrogen was used in the snout as shown in Example 5. Examples 6 and 7 illustrate the effect of high strip temperature and coating metal temperature. Higher atmosphere temperature in the furnace may increase the thickness of chromium oxide formed on the strip. In the presence of relatively high dew points (less reducing), the coating metal temperature had to be increased to about 1300°F (704°) to prevent uncoated areas on the strip. When the furnace and/or protective atmosphere are insufficiently reducing, the coating metal temperature may have to be increased to reduce the chromium oxide film from the strip to insure good wetting with the aluminum coating metal and thereby prevent uncoated areas from occurring.--.

Signed and Sealed this

Twenty-eighth Day of July, 1992

*Attest:*

DOUGLAS B. COMER

*Attesting Officer*

*Acting Commissioner of Patents and Trademarks*